US005728997A

United States Patent [19]

Kim et al.

[11] Patent Number: 5,728,997

[45] Date of Patent: Mar. 17, 1998

[54] APPARATUS FOR CONTROLLING POWER OF A MICROWAVE OVEN

[75] Inventors: Sang-Jin Kim, Incheon; Heung-Dae Kang, Kyunggi-Do, both of Rep. of Korea

[73] Assignee: Daewoo Electronics Co., Ltd., Seoul, Rep. of Korea

[21] Appl. No.: 686,372

[22] Filed: Jul. 25, 1996

[30] Foreign Application Priority Data

Jul. 26, 1995 [KR] Rep. of Korea ..... 95-18653
Jul. 26, 1995 [KR] Rep. of Korea ..... 95-18655

[51] Int. Cl.[6] ..... H05B 1/02

[52] U.S. Cl. ..... 219/702; 219/715; 219/720

[58] Field of Search ..... 219/702, 715, 219/716, 719, 720, 506; 99/325

[56] References Cited

U.S. PATENT DOCUMENTS 5,349,164 9/1994 Ohta ..... 219/715
5,455,403 10/1995 Kim et al. ..... 219/702
5,548,104 8/1996 Ko ..... 219/715
5,558,796 9/1996 Cho ..... 219/702
5,607,611 3/1997 Lee ..... 219/702

*Primary Examiner*—Philip H. Leung
*Attorney, Agent, or Firm*—Beveridge, DeGrandi, Weilacher & Young LLP

[57] ABSTRACT

An apparatus for controlling power of a microwave oven is disclosed in which the control thereof is easy and stable, and long-term durability is improved. The apparatus includes a control knob having a knob shaft to be inserted through a hole on a control panel, a coupler fixedly secured to the control knob shaft through the hole to be rotatably installed on the control panel together with the control knob, an annular projection integrally formed on one side of the coupler having several V-grooves formed along the peripheral surface of the annular projection, a resilient member, for instance, a wire or leaf spring, having a protrusion at a mid-position thereof, and a pair of pins for mounting the resilient member on the control panel. While controlling the power of the oven, the protrusion of the wire or leaf spring slides on the peripheral surface of the annular projection with resilient contact thereon, or remains resiliently fitted to any one of the V-grooves of the annular projection.

10 Claims, 3 Drawing Sheets

APPARATUS FOR CONTROLLING POWER OF A MICROWAVE OVEN

BACKGROUND OF THE INVENTION

1. Field of the Invention

The present invention relates to a power control apparatus, and more particularly, to an apparatus for precisely and stably controlling power of a microwave oven while simultaneously having improved long-term durability.

2. Description of the Prior Art

Typically, a simple functional microwave oven includes a power control knob, a timer knob, a button for door opening and closing and so on, on the control panel thereof in order to control the power of the microwave oven. In general, by turning the control knob, the power of the oven, that is, the output of a microwave generator such as a Magnetron, can be controlled and established according to the kind of food to be cooked. Also, by turning the timer knob, the cooking time can be controlled.

A conventional power control apparatus of a simple functional microwave oven will be described with reference to FIG. 1 below.

FIGS. 1 and 1A are sectional views schematically illustrating the conventional power control apparatus. Here, reference numerals 1 denotes a control panel having a hole 2 for installing the power control apparatus thereon. As illustrated in FIG. 1, a control knob 10 is inserted through the installing hole 2, and a coupler 20 is fixedly secured to a shaft 12 of the control knob 10 so that the control knob 10 can be rotatably mounted on the control panel 1 together with the coupler 20. The coupler 20 is engaged to a microwave generator such as a Magnetron, not illustrated. Therefore, by turning the control knob 10, the coupler 20 is rotated to control the output of the microwave generator, that is, the power of the microwave oven. The coupler 20 includes an annular projection 22 formed on one side thereof, and the annular projection 22 includes a plurality of grooves 24 formed along the peripheral surface thereof. A pair of resilient plates 3 are mounted on the inner side wall of the control panel 1 so that the plates 3 can remain in resilient contact on the peripheral surface of the annular projection 22. In the inner side of each of the resilient plates 3, a protrusion 3*a* is formed, which is intermittently engaged with the grooves 24 of the annular projection 22 while the control knob 10, that is, the coupler 20 turns.

In order to control the power of the microwave oven, when a user rotates the control knob 10 of which the shaft 12 rotates the coupler 20, the protrusion 3*a* is intermittently engaged with the grooves 24 of the annular projection of the coupler 20 by the resilience of the plates 3. Therefore, the user can establish a desired power of the oven.

In the above described conventional control apparatus, however, several problems to be solved have been encountered. By repeated rotation of the coupler 20 and also long-term service thereof, the resilient plates 3 frequently get fractured or deformed, the resilience of the plates 3 become degraded, or the protrusion 3*a* thereon is worn away. Therefore, it is not easy to control or establish the desired power of the microwave oven and maintain the established state thereof. These problems become more severe when using the microwave oven in a hot and humid area such as the equatorial district.

SUMMARY OF THE INVENTION

To solve the above problems, an object of the invention is to provide an improved power control apparatus for precisely controlling power of an microwave oven and stably maintaining the established or controlled power state while simultaneously having improved long-term durability.

To achieve the object of the invention, there is provided a power control apparatus, which comprises a control panel having an installing hole formed thereon, a control knob having a knob shaft which is inserted through the installing hole on the control panel, and a coupler fixedly secured to the knob shaft of the control knob through the installing hole so that the coupler can be rotatably installed on the control panel together with the control knob. The coupler, which is connected to a microwave generator such as a Magnetron, includes an annular projection formed integrally on one side thereof. The annular projection includes a plurality of V-grooves formed at circumferentially interspaced distances in the peripheral surface of the annular projection. Also the apparatus includes a resilient member having a protrusion at a longitudinally intermediate position thereof, and a fixing member for mounting the resilient member on the control panel so that the protrusion remains in resilient contact on the peripheral surface of the annular projection.

Preferably, the resilient member can be embodied by an open circular wire spring having a pair of hooks formed at both of the ends, and the fixing member by a pair of pins fixed on the control panel. The hooks are fixedly engaged with the pins so that the wire spring can be installed around the annular projection with the protrusion of the spring in resilient contact on the peripheral surface of the projection.

An open circular leaf spring can be used as an alternative to the open circular wire spring, and the pins can further include a slit formed which is suitable to fixedly fit both ends of the open circular leaf spring.

Similarly, as another alternative to the resilient member a linear leaf spring can be used so that the protrusion thereof remains tangentially in resilient contact on the peripheral surface of the annular projection. The linear leaf spring can further include a pair of hooks formed at both ends thereof, and the hooks can be engaged with the pins to mount the spring on the control panel. Also the pins can further include a slit formed which is suitable to fixedly fit both ends of the linear leaf spring.

With the construction described as above, in order to control the power of the microwave oven, when the control knob, that is, the coupler is rotated, the protrusion of the wire or leaf spring slides on the peripheral surface of the annular projection with resilient contact thereon. During the sliding, the protrusion meets with any one of the V-grooves, and then by the elasticity of the wire or leaf spring the protrusion will fit into the V-groove. At that time, the microwave oven is set to a certain power state corresponding to the above V-groove, and this established power state is continuously and stably maintained by the elasticity of the spring.

When the control knob is rotated again for converting to another power state, the protrusion fitted to the above V-groove slides up along the slant face of the groove against the resilient force of the spring and again runs slidably on the peripheral surface of the annular projection until it encounters another V-groove and is fitted thereto, which corresponds to a microwave output desired to be set again. Therefore, with the repeat of the above operation, a user can easily control and establish the power of the microwave oven.

BRIEF DESCRIPTION OF THE DRAWINGS

Other features and advantages of the invention will be apparent from the following description taken in connection with the accompanying drawings wherein.

DETAILED DESCRIPTION OF THE PREFERRED EMBODIMENT

Hereinafter, this invention will be described in further detail by way of several preferred embodiments with reference to the accompanying drawings.

Figure 1:
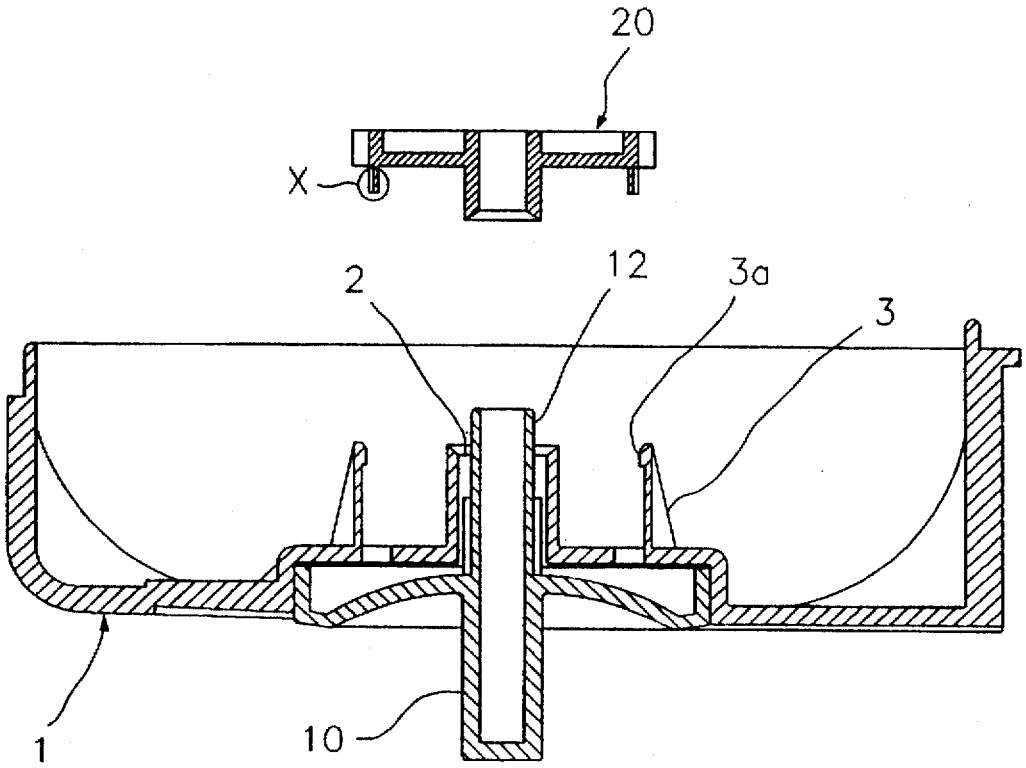
FIG. 1 PRIOR ART
FIG. 1 is a sectional top view showing an exploded state of a conventional power control apparatus.
Figure 1A:
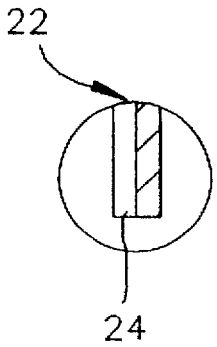
FIG. 1A PRIOR ART
FIG. 1A is an enlarged view showing portion X of FIG. 1.
Figure 2:
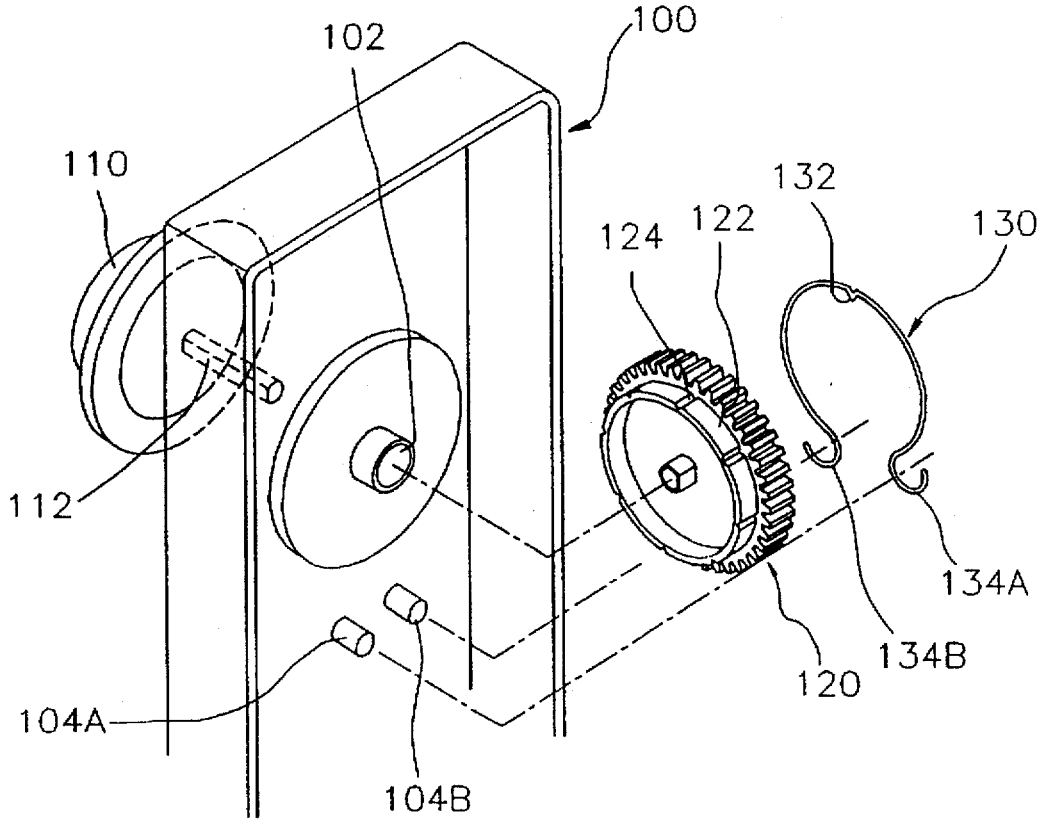
FIG. 2 is a perspective view showing an exploded state of a preferred embodiment of this invention.

Referring to FIG. 2, there is shown a preferred embodiment of a power control apparatus according to the present invention. In the figure, reference numerals 100 and 102 denote respectively a control panel of a microwave oven and an installing hole for the power control apparatus of the invention. As illustrated in FIG. 2, the power control apparatus of the invention includes a control knob 110 having a knob shaft 112 which is inserted through the installing hole 102, and a coupler 120 is fixedly fitted to the knob shaft 112 of the control knob 110 through the hole 102 so that the coupler 120 can be rotatably mounted on the control panel 100 together with the control knob 110. The coupler 120 is engaged with a microwave generator such as a Magentron, not shown in the FIG. 2. The coupler 120 includes an annular projection 122 integrally formed on one side thereof, and the annular projection 122 includes a plurality of V-grooves 124 formed at circumferentially interspaced distances in the peripheral surface thereof. The number of V-grooves corresponds to that of power steps desired to be controlled.

In addition, the invention includes a resilient member having a protrusion at a longitudinally intermediate position thereof, and a fixing member for mounting the resilient member on the control panel so that the protrusion remains in resilient contact on the peripheral surface of the annular projection.

In this embodiment, an open circular wire spring 130 can be preferably used as the resilient member and a pair of pins 104A, 104B as the mounting member as illustrated in FIG. 2. The wire spring 130 includes a protrusion 132 formed in the longitudinally intermediate position thereof and a pair of hooks 134A, 134B formed at both ends of the wire spring 130. When the pair of hooks 134A, 134B are engaged with the pair of pins 104A, 104B, respectively, the open circular wire spring 130 is resiliently installed around the annular projection 122 so that the protrusion 132 abuts resiliently against the peripheral surface of the annular projection 122.

Figure 3A:
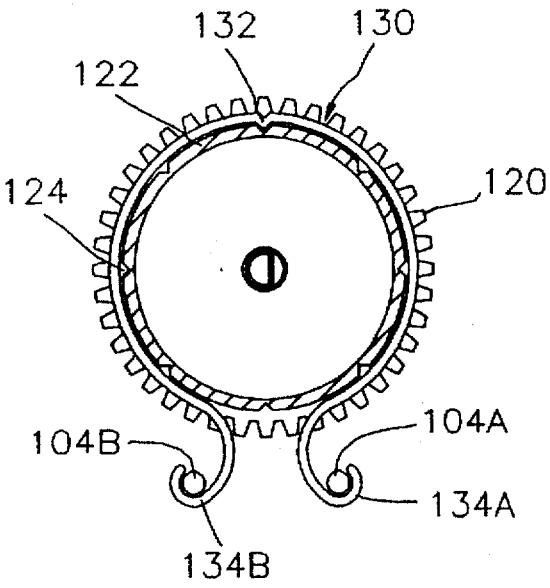
FIG. 3A is an elevational view being directed from a back surface of a control panel toward a coupler showing the operation of the embodiment in FIG. 2.
Figure 3B:
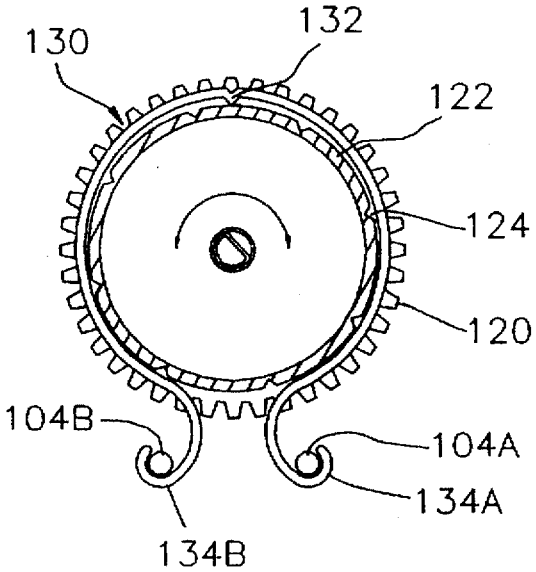
FIG. 3B is a view similar to FIG. 3A showing the operation of the embodiment in FIG. 2.

FIGS. 3A and 3B illustrate the operation of the power control apparatus according to the invention. FIG. 3A shows an established state for a certain power, and FIG. 3B shows the conversion process from the above power state to another one.

As illustrated FIG. 3B, in order to control the power of the microwave oven, when the control knob 110, that is, the coupler 120 is rotated, the protrusion 132 of the open circular wire spring 130 slides on the peripheral surface of the annular projection 122 with resilient contact thereon. During the sliding, the protrusion 132 meets with any one of the plurality of V-grooves 124, and then by the elasticity of the wire spring 130 the protrusion 132 is fitted to the V-groove 124 as illustrated in FIG. 3A. Referring to FIG. 3A, there is shown an established state for a certain power by the above described operation, in which the established state corresponds to the above V-groove and is continuously and stably maintained by the elasticity of the open circular wire spring 130.

In the state as illustrated in FIG. 3A, when the control knob 110 is rotated again for converting to another power state, the protrusion 132 fitted to the above V-groove slides up along the slant face of the groove against the resilient force of the wire spring 130 and again runs slidably on the peripheral surface of the annular projection 122 until it encounters another V-groove and becomes fitted thereto, which corresponds to a microwave output desired to be established again. Therefore, with the repeat of the above operation, a user can easily control or establish the power of the microwave oven.

It will be understood by those skilled in the art that a open circular leaf spring can be used as an alternative to the open circular wire spring 130. In addition, the pair of pins 104A, 104B can further include a slit formed perpendicularly to the inner side wall of the control panel 100 so that both ends of the open circular leaf spring can be fixedly fitted to the slit for installing the leaf spring around the annular projection 122, as hereinafter described.

Figure 4:
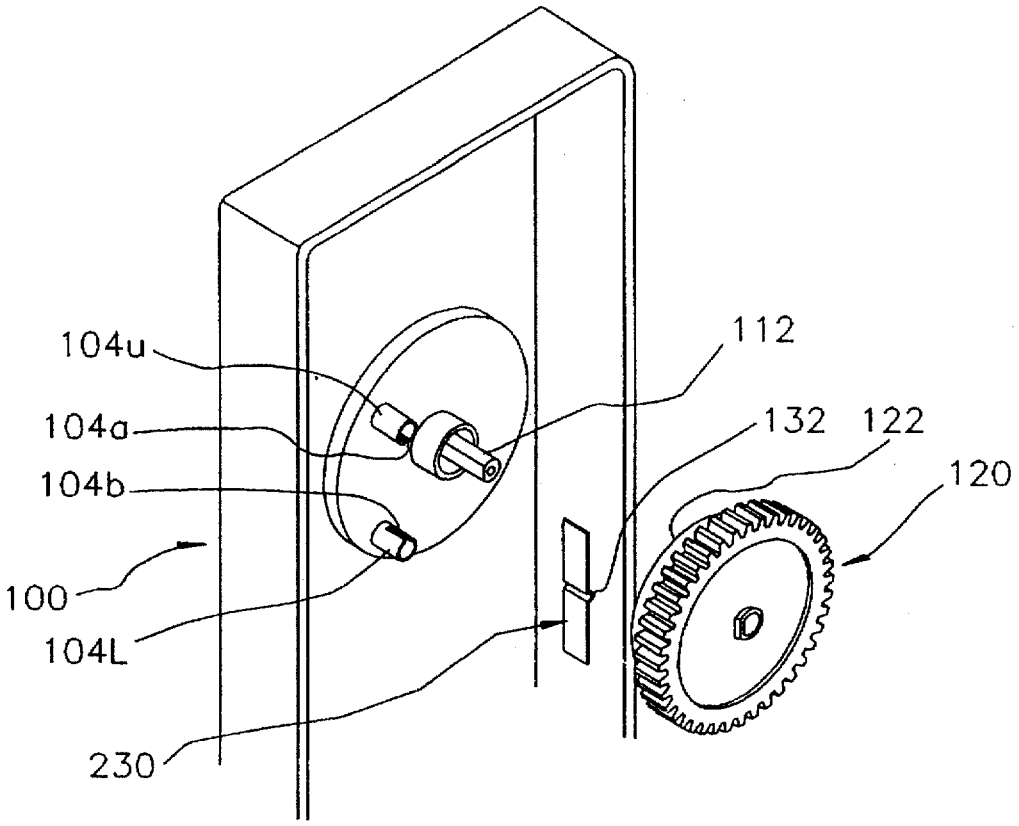
FIG. 4 is a perspective view showing an exploded state of another preferred embodiment of this invention.
Figure 5A:
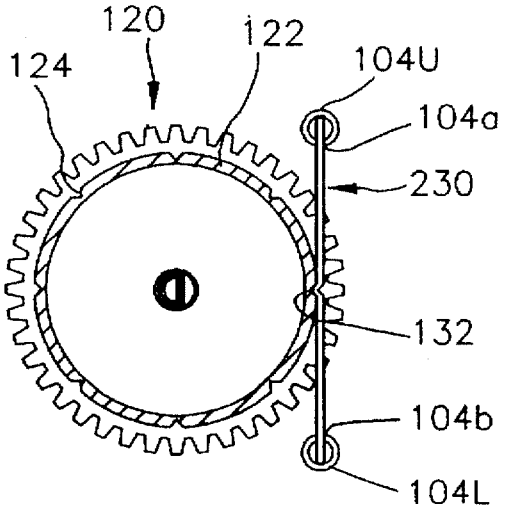
FIG. 5A is an elevational view being directed from a back surface of a control panel toward a coupler showing the operation of the embodiment in FIG. 4.
Figure 5B:
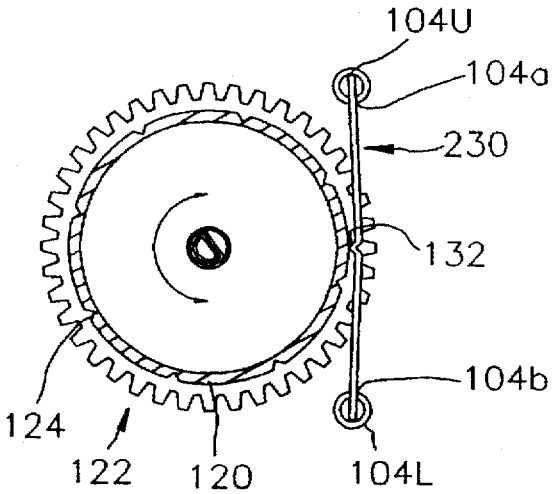
FIG. 5B is a view similar to FIG. 5A showing the operation of the embodiment in FIG. 4.

FIG. 4, and FIGS. 5A and 5B illustrate another embodiment of the invention.

The embodiment of FIG. 4 is similar to the above described one with the exceptions that, as the resilient member, a linear leaf spring 230 is used alternatively instead of the open circular wire spring or the open circular leaf spring 130, and that the pair of pins 104U, 104L further includes a slit **104*a*, 104*b* formed perpendicularly to the control panel 100 so that both ends of the linear leaf spring 230 can be fixedly fitted into the slits 104*a*, 104*b* for mounting the linear leaf spring 230 on the control panel 100. Similarly the linear leaf spring 230 includes a protrusion 132** formed at the intermediate position thereof as shown in the figure.

Referring to FIGS. 5A and 5B, there is illustrated the operation of the above embodiment, similar to FIGS. 3A and 3B.

As illustrated in the figures, both ends of the linear leaf spring 230 are fixedly fitted at the slits **104*a*, 104*b* of the pair of pins 104U, 104L so that the protrusion 132 of the leaf spring 230 becomes in resilient contact on the peripheral surface of the annular projection 122 with the leaf spring having a tangential relationship with the annular projection 122. Therefore, when the control knob 110, not shown in the figures, is rotated to control the power of the microwave oven, the linear leaf spring 230, the protrusion 132 thereof, and the plurality of the V-grooves 124 of annular projection 122** all cooperates similarly to that of the preceding embodiment.

It will be understood by those skilled in the art that the linear leaf spring 230 can further include a pair of hooks formed at both ends thereof suitable to engage with the pair of pins 104U, 104L, regardless of which of the pins 104U, 104L have a slit or not. And also in the above described embodiments according to the invention, the protrusion 132 of the spring 130 and 230 can be formed by bending in part the spring itself or by welding it on the springs.

As clearly described in the above, the disadvantages of the conventional power control apparatus could be solved according to the present invention. That is, the cooperation among the resilience of the resilient members 130 and 230, the protrusion 132 thereof, and the plurality of V-grooves 124 in the peripheral surface of the annular projection 122 could make it easy to control the power of a microwave oven and stably maintain the controlled state thereof. Furthermore the long-term durability could be significantly improved.

While the present invention has been particularly shown and described with reference to preferred embodiments thereof, it will be understood by those skilled in the art that various changes in form and details may be effected therein without departing from the spirit and scope of the invention as defined by the appended claims.

What is claimed is:

1. An apparatus for controlling power of a microwave oven, the apparatus comprising:

(a) a control panel having an installing hole formed thereon;

(b) a control knob having a knob shaft which is inserted through the installing hole on the control panel;

(c) a planar coupler fixedly secured to the knob shaft of the control knob through the installing hole, the planar coupler being rotatably installed on the control panel together with the control knob for controlling the output of a microwave generator of the microwave oven;

(d) an annular projection integrally formed on one side surface of the coupler facing the control panel and including a plurality of V-grooves formed at circumferentially interspaced distances in a peripheral surface of the annular projection;

(e) a resilient means for restricting a free rotation of the planar coupler and including a protrusion at a longitudinally intermediate position thereof, and the protrusion engaging any one of the plurality of V-grooves under the elasticity of the resilient means during the rotation of the coupler; and (f) a fixing means for mounting the resilient means on the control panel, whereby the protrusion of the resilient member remains in resilient contact on the peripheral surface of the annular projection of the planar coupler.

2. The apparatus as claimed in claim 1, wherein the resilient means is an open circular wire spring having a pair of hooks formed at both ends thereof, and the fixing means is a pair of pins for the hooks of the open circular wire spring to be engaged therewith.

3. The apparatus as claimed in claim 1, wherein the resilient means is an open circular leaf spring.

4. The apparatus as claimed in claim 3, wherein the open circular leaf spring has a pair of hooks formed at both ends thereof, and the fixing means is a pair of pins for the hooks of the open circular leaf spring to be engaged therewith.

5. The apparatus as claimed in claim 4, wherein each of the pins is a pin having a slit for fitably receiving an end of the open circular leaf spring.

6. The apparatus as claimed in claim 1, wherein the resilient means is a linear leaf spring.

7. The apparatus as claimed in claim 6, wherein the linear leaf spring has a pair of hooks formed at both ends thereof, and the fixing means is a pair of pins for the hooks of the linear leaf spring to be engaged therewith.

8. The apparatus as claimed in claim 7, wherein each of the pins is a pin having a slit for fitably receiving an end of the linear leaf spring.

9. The apparatus as claimed in claim 1, wherein the protrusion is formed by bending in a part of the resilient means.

10. The apparatus as claimed in claim 1, wherein the protrusion is formed by welding it to the resilient means.

* * * * *